US005566940A

United States Patent [19]

Powell

[11] Patent Number: 5,566,940

[45] Date of Patent: Oct. 22, 1996

[54] AIR DRIVEN LOTTERY GAME

[76] Inventor: John W. Powell, 1864 Haynie, Augusta, Ga. 30904

[21] Appl. No.: 562,831

[22] Filed: Nov. 27, 1995

[51] Int. Cl.[6] ..... A63F 3/06

[52] U.S. Cl. ..... 273/144 A; 273/144 B

[58] Field of Search ..... 273/138 A, 144 R, 273/144 A, 144 B

[56] References Cited

U.S. PATENT DOCUMENTS

| | | | |
|---|---|---|---|
| 2,315,323 | 3/1943 | Fostos | 273/144 A |
| 5,062,635 | 4/1991 | Tse et al. | 273/144 A |
| 5,088,737 | 2/1992 | Frank et al. | 273/144 B |
| 5,121,920 | 6/1992 | Laezzo et al. | 273/144 A |
| 5,380,007 | 1/1995 | Travis et al. | 273/144 B |

*Primary Examiner*—William M. Pierce

[57] ABSTRACT

An air driven lottery game comprised of a control box having at least one opening formed therein. The openings are fitted with a rubber stopping mechanism. The control box has an electrical plug or a battery compartment extending outwardly therefrom. A side surface of the control box has a vent formed therein. The device contains at least one ball dispenser. The ball dispenser has a cylindrical configuration. The ball dispenser is adapted for removably coupling within the opening in the control box. The ball dispenser holds a plurality of lottery balls therein. At least one ball display container is secured to the ball dispenser adapted to receive one of the plurality of lottery balls therethrough. An electric or battery operated fan is secured within the control box inwardly of the vent in the side surface thereof. The electric or battery operated fan is electrically coupled with the electric plug or with batteries.

3 Claims, 3 Drawing Sheets

AIR DRIVEN LOTTERY GAME

BACKGROUND OF THE INVENTION

1. Field of the Invention

The present invention relates to an air driven lottery game and more particularly pertains to simulating a lottery ball action picking machine used in state lotteries with an air driven lottery game.

2. Description of the Prior Art

The use of ball mixers and selectors is known in the prior art. More specifically, ball mixers and selectors heretofore devised and utilized for the purpose of mixing and dispensing balls are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,121,920 to Laezzo et al. discloses an air driven random ball type lot mixer.

U.S. Pat. No. 4,834,385 to Jackson discloses a random ball selector apparatus.

U.S. Pat. No. 4,385,763 to Moscovich discloses a pattern forming ball game.

U.S. Pat. No. 3,856,312 to Dabrowski discloses a manually actuated ball mixing and dispensing device.

U.S. Pat. No. 3,658,341 to Curtner discloses a ball mixing device.

While these devices fulfill their respective, particular objective and requirements, the aforementioned patents do not describe an air driven lottery game for simulating a lottery ball action picking machine used in state lotteries.

In this respect, the air driven lottery game according to the present invention substantially departs from the conventional concepts and designs of the prior art, and in doing so provides an apparatus primarily developed for the purpose of simulating a lottery ball action picking machine used in state lotteries.

Therefore, it can be appreciated that there exists a continuing need for new and improved air driven lottery game which can be used for simulating a lottery ball action picking machine used in state lotteries. In this regard, the present invention substantially fulfills this need.

SUMMARY OF THE INVENTION

In the view of the foregoing disadvantages inherent in the known types of ball mixers and selectors now present in the prior art, the present invention provides an improved air driven lottery game. As such, the general purpose of the present invention, which will be described subsequently in greater detail, is to provide a new and improved air driven lottery game and method which has all the advantages of the prior art and none of the disadvantages.

To attain this, the present invention essentially comprises a control box having a generally rectangular configuration. The control box has an top surface, a bottom surface, a front surface, a rear surface, and two side surfaces. The top surface has a first portion being parallel with the bottom surface and a second portion angling downwardly from the first portion to the front surface. The first portion has three openings formed therein spaced equidistantly from each other. Each of the openings is fitted with a rubber stopping mechanism. The control box has an electrical plug or a battery compartment extending outwardly of the rear surface thereof. One of the two side surfaces has a vent formed therein. The device contains at least one ball dispenser. The ball dispenser has a cylindrical configuration. The ball dispenser has an open first end and a closed second end. The open first end is adapted for removably coupling within one of the openings in the first portion of the upper surface of the control box. The closed second end has an opening formed therethrough. The ball dispenser holds a plurality of lottery balls therein. The device contains at least one ball display container having an open first end and an open second end. The open first end is secured to the closed second end of the ball dispenser atop the opening formed therethrough. The open first end is adapted to receive one of the plurality of lottery balls therethrough. The open second end has a lid hingedly secured thereto. The container has a slot formed through an intermediate portion thereof. The slot receives a sliding door therein. The sliding door separates the container into an upper portion and a lower portion. The sliding door selectively allows one of the lottery balls to enter into the upper portion. An electric or battery operated fan is secured within the control box inwardly of the vent in the side surface thereof. The electric or battery operated fan is electrically coupled with the electric plug or with batteries. A control panel is secured within the second portion of the upper surface of the control box. The control panel is electrically coupled with the electric plug or with batteries. A display panel is secured within the second portion of the upper surface of the control box. The display panel is electrically coupled with the electric plug or with batteries. An on/off switch is secured within the second portion of the upper surface of the control box. The on/off switch is electrically coupled with the electric plug or with batteries. The on/off switch controls the activation of the electric or battery operated fan, the control panel, and the display panel.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved air driven lottery game which has all the advantages of the prior art ball mixers and selectors and none of the disadvantages.

It is another object of the present invention to provide a new and improved air driven lottery game which may be easily and efficiently manufactured and marketed.

It is a further object of the present invention to provide a new and improved air driven lottery game which is of durable and reliable construction.

An even further object of the present invention is to provide a new and improved air driven lottery game which is susceptible of a low cost of manufacture with regard to both materials and labor, and which accordingly is then susceptible of low prices of sale to the consuming public, thereby making such an air driven lottery game economically available to the buying public.

Still yet another object of the present invention is to provide a new and improved air driven lottery game which provides in the apparatuses and methods of the prior art some of the advantages thereof, while simultaneously overcoming some of the disadvantages normally associated therewith.

Even still another object of the present invention is to provide a new and improved air driven lottery game for simulating a lottery ball action picking machine used in state lotteries.

Lastly, it is an object of the present invention to provide a new and improved air driven lottery game comprised of a control box having at least one opening formed therein. The openings are fitted with a rubber stopping mechanism. The control box has an electrical plug or a battery compartment extending outwardly therefrom. A side surface of the control box has a vent formed therein. The device contains at least one ball dispenser. The ball dispenser has a cylindrical configuration. The ball dispenser is adapted for removably coupling within the opening in the control box. The ball dispenser holds a plurality of lottery balls therein. At least one ball display container is secured to the ball dispenser adapted to receive one of the plurality of lottery balls therethrough. An electric or battery operated fan is secured within the control box inwardly of the vent in the side surface thereof. The electric or battery operated fan is electrically coupled with the electric plug or with the batteries.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
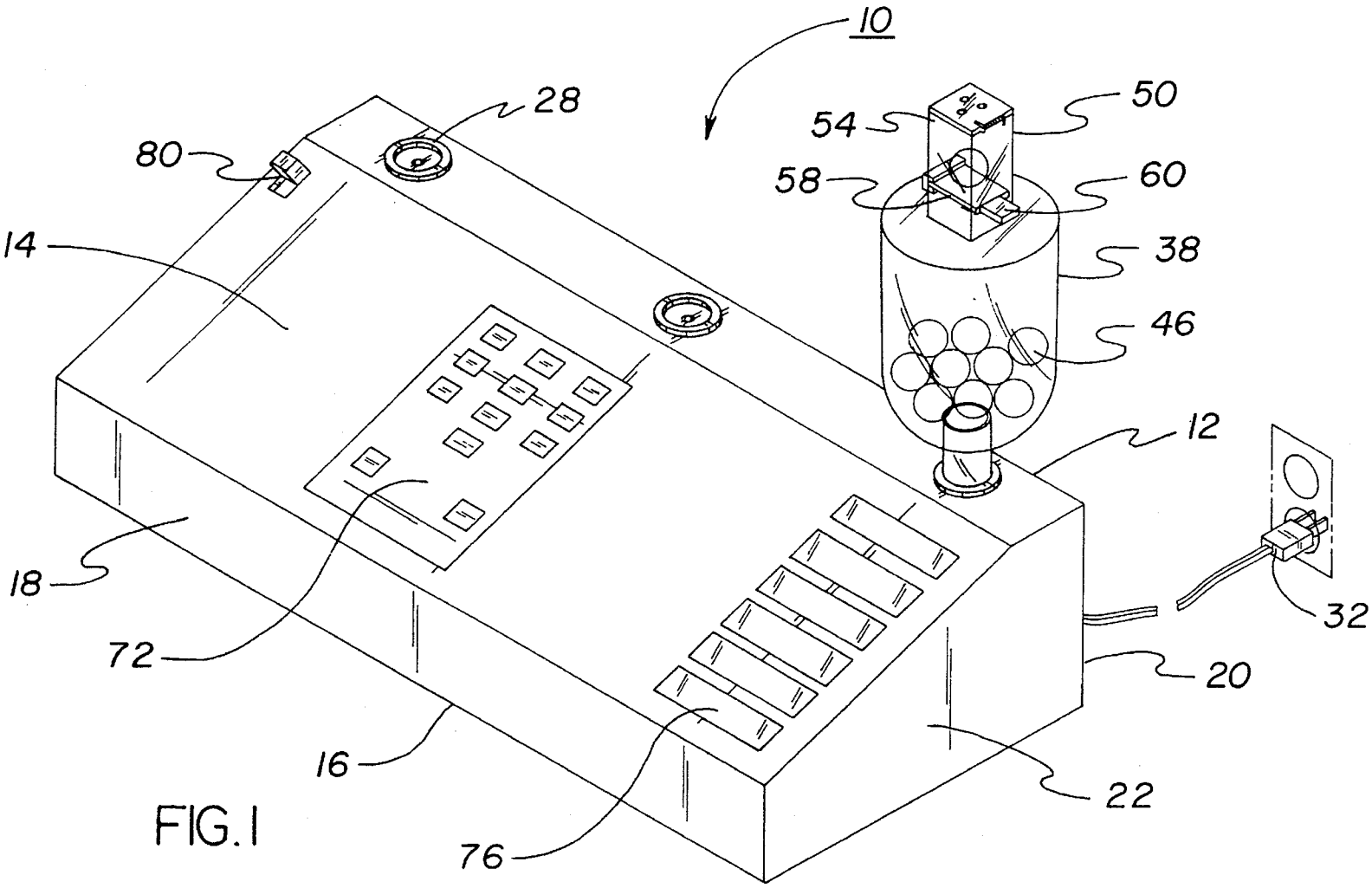
FIG. 1 is a perspective view of the preferred embodiment of the air driven lottery game constructed in accordance with the principles of the present invention.
Figure 3:
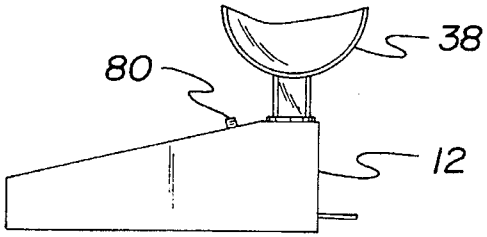
FIG. 3 is a side elevation view of the present invention.
Figure 2:
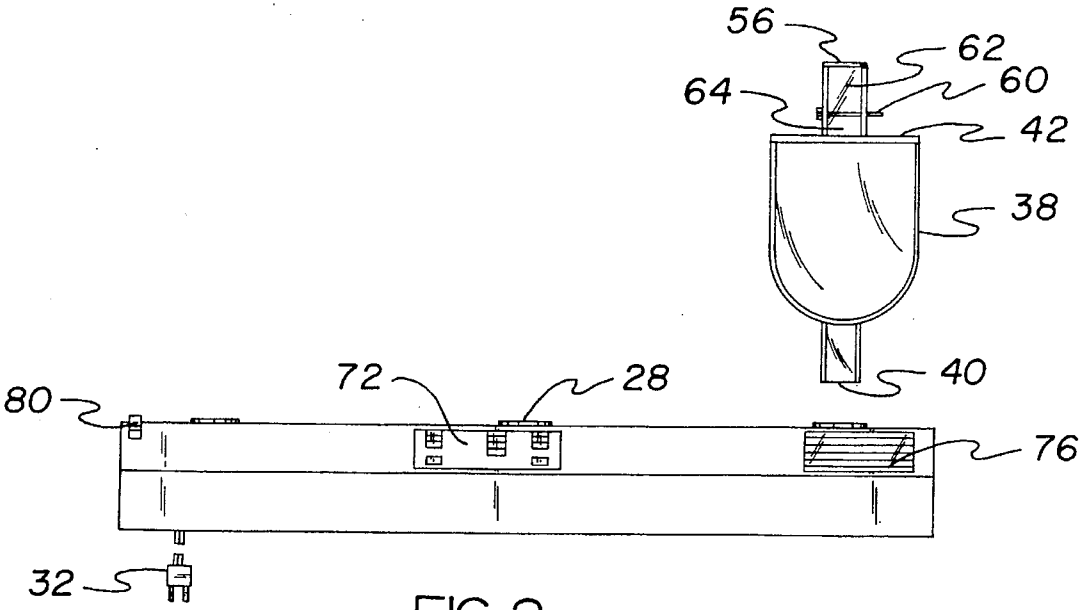
FIG. 2 is a front elevation view of the present invention.
Figure 4:
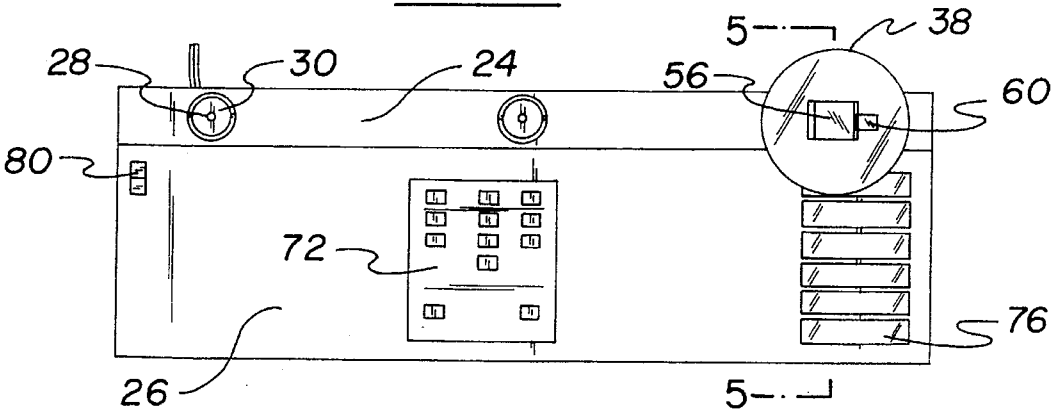
FIG. 4 is a plan view of the preferred embodiment of the present invention.
Figure 5:
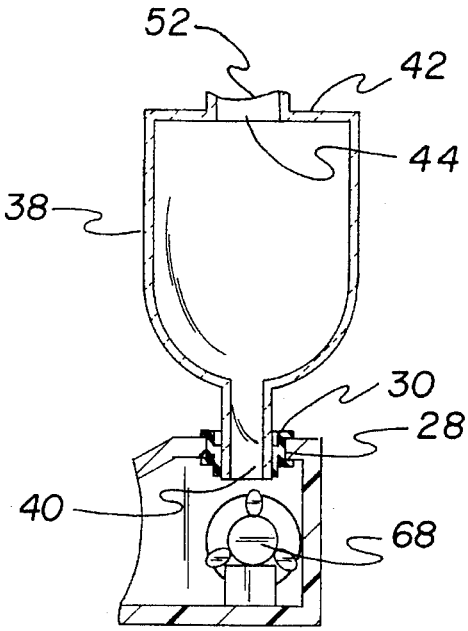
FIG. 5 is a cross-sectional view as taken along line 5—5 of FIG. 4.
Figure 6:
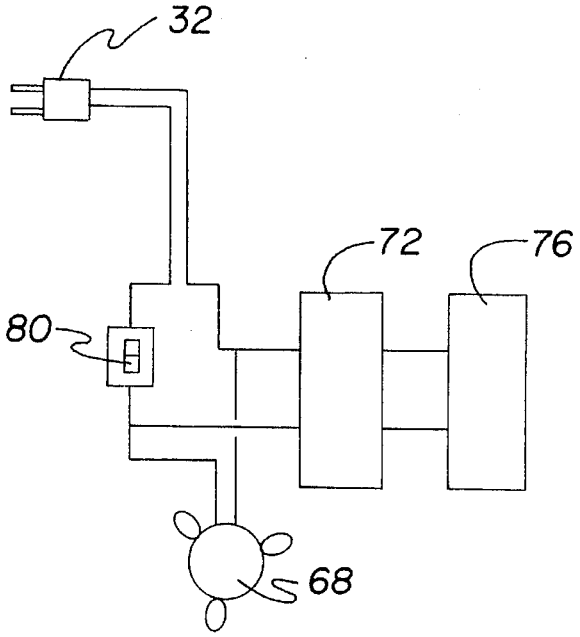
FIG. 6 is a schematical drawing of the present invention.
Figure 7:
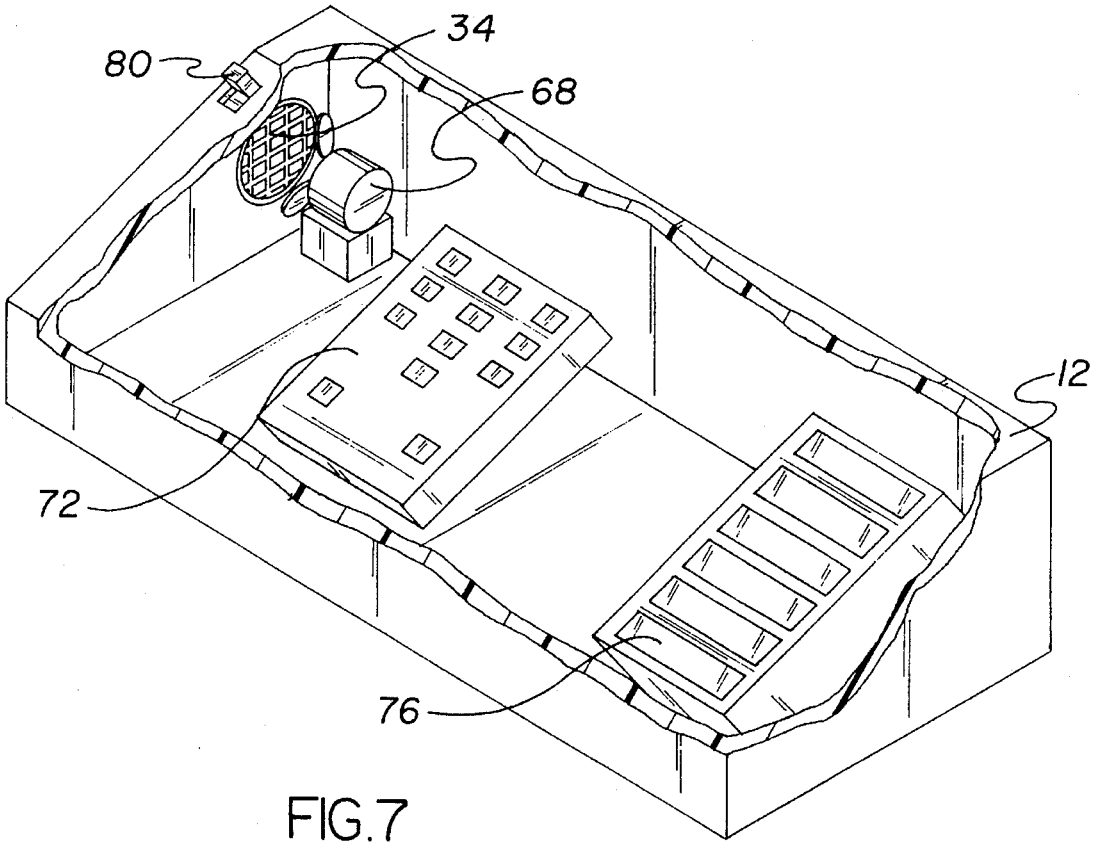
FIG. 7 is a perspective view of the present invention illustrating the interior of the control box.

With reference now to the drawings, and in particular, to FIG. 1 thereof, the preferred embodiment of the new and improved air driven lottery game embodying the principles and concepts of the present invention and generally designated by the reference number 10 will be described.

Specifically, it will be noted in the various Figures that the device relates to a new and improved air driven lottery game for simulating a lottery ball action picking machine used in state lotteries. In its broadest context, the device consists of a control box, at least one ball dispenser, at least one ball display container, an electric or battery operated fan, a control panel, a display panel, and an on/off switch. Such components are individually configured and correlated with respect to each other so as to attain the desired objective.

The first component of the device 10 is a control box 12. The control box 12 has a generally rectangular configuration. The control box 12 has an top surface 14, a bottom surface 16, a front surface 18, a rear surface 20, and two side surfaces 22. The top surface 14 has a first portion 24 being parallel with the bottom surface 16 and a second portion 26 angling downwardly from the first portion 24 to the front surface 18. The first portion 24 has three openings 28 formed therein spaced equidistantly from each other. Each of the openings 28 is fitted with a rubber stopping mechanism 30. The control box 12 has an electrical plug 32 extending outwardly of the rear surface 20 thereof. One of the two side surfaces 22 has a vent 34 formed therein.

The second component of the device 10 is at least one ball dispenser 38. The ball dispenser 38 has a cylindrical configuration. The ball dispenser 38 has an open first end 40 and a closed second end 42. The open first end 40 is adapted for removably coupling within one of the openings 28 in the first portion 24 of the upper surface 14 of the control box 12. The closed second end 42 has an opening 44 formed therethrough. The ball dispenser 38 holds a plurality of lottery balls 46 therein. The preferred number of ball dispensers 38 is three, corresponding to the number of openings 28 in the control box 12. The open first end 40 is tapered so as to prevent the lottery balls 46 from going therethrough.

The third component of the device 10 is at least one ball display container 50. The ball display container 50 has an open first end 52 and an open second end 54. The open first end 52 is secured to the closed second end 42 of the ball dispenser 38 atop the opening 44 formed therethrough. The open first end 52 is adapted to receive one of the plurality of lottery balls 46 therethrough. The open second end 54 has a lid 56 hingedly secured thereto. The container 50 has a slot 58 formed through an intermediate portion thereof. The slot 58 receives a sliding door 60 therein. The sliding door 60 separates the container 50 into an upper portion 62 and a lower portion 64. The sliding door 60 selectively allows one of the lottery balls 46 to enter into the upper portion 64.

The fourth component of the device 10 is an electric or battery operated fan 68. The electric or battery operated fan 68 is secured within the control box 12 inwardly of the vent 34 in the side surface thereof. The electric or battery operated fan 68 is electrically coupled with the electric plug 32 or with batteries. Activation of the electric or battery operated fan 68 will cause an air flow to enter into the ball dispenser 38 thereby causing the lottery balls 46 to circulate therein thus mixing the balls 46. One of the lottery balls 46 will then enter into the lower portion 64 of the ball display container 50. The user can then remove the sliding door 60 to allow the lottery ball 46 to enter into the upper portion 62 of the ball display container 50. The lid 56 can then be lifted to remove the selected lottery ball 46.

The fifth component of the device 10 is a control panel 72. The control panel 72 is secured within the second portion 26 of the upper surface 14 of the control box 12. The control panel 72 is electrically coupled with the electric plug 32 or with batteries. The control panel 72 allows a user to program numbers that the user will guess as to be the winning lottery balls 46 that will be pulled from the ball dispenser 38. The technology utilized in the control panel is similar to that employed in the art of calculators, computers, and the like and is therefore commonly known and commercially available. As shown in the Figures, push buttons are included to facilitate the aforementioned use of the control panel.

The sixth component of the device 10 is a display panel 76. The display panel 76 is secured within the second portion 26 of the upper surface 14 of the control box 12. The display panel 76 is electrically coupled with the electric plug 32 or with batteries. The display panel 76 will display the numbers that are programmed by the user into the control panel 72.

The final component of the device 10 is an on/off switch 80. The on/off switch 80 is secured within the second portion 26 of the upper surface 14 of the control box 12. The on/off switch 80 is electrically coupled with the electric plug 32 or with batteries. The on/off switch 80 controls the activation of the electric or battery operated fan 68, the control panel 72, and the display panel 76.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. An air driven lottery game for simulating a lottery ball action picking machine used in state lotteries comprising, in combination:

a control box having a generally rectangular configuration, the control box having a top surface, a bottom surface, a front surface, a rear surface, and two side surfaces, the top surface having a first portion being parallel with the bottom surface and a second portion angling downwardly from the first portion to the front surface, the first portion having three openings formed therein spaced equidistantly from each other, each of the openings being fitted with a rubber stopping mechanism, the control box having a power source extending outwardly of the rear surface thereof, one of the two side surfaces having a vent formed therein;

at least one ball dispenser, the ball dispenser having a cylindrical configuration, the ball dispenser having an open first end and a closed second end, the open first end adapted for removably coupling within one of the openings in the first portion of the upper surface of the control box, the closed second end having an opening formed therethrough, the ball dispenser holding a plurality of lottery balls therein;

at least one ball display container having an open first end and an open second end, the open first end secured to the closed second end of the ball dispenser atop the opening formed therethrough, the open first end being adapted to receive one of the plurality of lottery balls therethrough, the open second end having a lid hingedly secured thereto, the container having a slot formed through an intermediate portion thereof, the slot receiving a sliding door therein, the sliding door separating the container into an upper portion and a lower portion, the sliding door selectively allowing one of the lottery balls to enter into the upper portion;

an electric or battery operated fan secured within the control box inwardly of the vent in the side surface thereof, the electric or battery operated fan being electrically coupled with an electric plug or with batteries;

a control panel secured within the second portion of the upper surface of the control box, the control panel being electrically coupled with an electric plug or with batteries for allowing a user to program numbers that the user will guess as to be the lottery balls that will be pulled from the ball dispenser;

a display panel secured within the second portion of the upper surface of the control box, the display panel being electrically coupled with an electric plug or with batteries for displaying the numbers that are programmed by the user into the control panel; and an on/off switch secured within the second portion of the upper surface of the control box, the on/off switch being electrically coupled with an electric plug or with batteries, the on/off switch controlling the activation of the electric or battery operated fan, the control panel, and the display panel.

2. An air driven lottery game for simulating a lottery ball action picking machine used in state lotteries comprising:

a control box having at least one opening formed therein, the control box having a power source and a vent formed therein;

at least one ball dispenser, the ball dispenser having a cylindrical configuration, the ball dispenser adapted for removably coupling within the opening in the control box, the ball dispenser holding a plurality of lottery balls therein;

at least one ball display container secured to the ball dispenser adapted to receive one of the plurality of lottery balls therethrough, wherein the ball display container has an open first end and an open second end, the open first end secured to the closed second end of the ball dispenser atop the opening formed therethrough, the open first end being adapted to receive one of the plurality of lottery balls therethrough, the open second end having a lid hingedly secured thereto, the container having a slot formed through an intermediate portion thereof, the slot receiving a sliding door therein, the sliding door separating the container into an upper portion and a lower portion, the sliding door selectively allowing one of the lottery balls to enter into the upper portion; and an electric or battery operated fan secured within the control box inwardly of the vent, the electric fan being electrically coupled with the power source.

3. An air driven lottery game for simulating a lottery ball action picking machine used in state lotteries comprising:

a control box having at least one opening formed therein, at least one opening being fitted with a rubber stopping mechanism, the control box having an electrical plug or a battery compartment extending outwardly therefrom and a side surface having a vent formed therein;

at least one ball dispenser, the ball dispenser having a cylindrical configuration, the ball dispenser adapted for removably coupling within the opening in the control box, the ball dispenser holding a plurality of lottery balls therein;

at least one ball display container secured to the ball dispenser adapted to receive one of the plurality of lottery balls therethrough, the ball display container having an open first end and an open second end, the open first end secured to the closed second end of the ball dispenser atop the opening formed therethrough, the open first end being adapted to receive one of the plurality of lottery balls therethrough, the open second end having a lid hingedly secured thereto, the container having a slot formed through an intermediate portion thereof, the slot receiving a sliding door therein, the sliding door separating the container into an upper portion and a lower portion, the sliding door selectively allowing one of the lottery balls to enter into the upper portion; and an electric or battery operated fan secured within the control box inwardly of the vent in the side surface thereof, the electric fan being electrically coupled with the electric plug or with batteries.

* * * * *